US010422198B2

(12) United States Patent
Ridgway et al.

(10) Patent No.: US 10,422,198 B2
(45) Date of Patent: Sep. 24, 2019

(54) MAGNETIC RANGING FROM BEHIND A MAGNETIC SHIELD

(71) Applicant: Scientific Drilling International, Inc., Houston, TX (US)

(72) Inventors: Douglas Ridgway, Edmonton (CA); Clinton Moss, Calgary (CA)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 68 days.

(21) Appl. No.: 15/589,560

(22) Filed: May 8, 2017

(65) Prior Publication Data

US 2017/0322013 A1 Nov. 9, 2017

Related U.S. Application Data

(60) Provisional application No. 62/333,695, filed on May 9, 2016.

(51) Int. Cl.

| | |
|---|---|
| ***E21B 47/09*** | (2012.01) |
| ***E21B 33/12*** | (2006.01) |
| ***E21B 7/04*** | (2006.01) |
| ***E21B 47/022*** | (2012.01) |

(52) U.S. Cl.
CPC ..... *E21B 33/12* (2013.01); *E21B 7/04* (2013.01); *E21B 47/02216* (2013.01)

(58) Field of Classification Search
CPC ..... E21B 7/04; E21B 47/122
USPC ..... 175/45
See application file for complete search history.

(56) References Cited

U.S. PATENT DOCUMENTS

| | | | |
|---|---|---|---|
| 5,258,755 | A | 11/1993 | Kuckes |
| 2012/0138291 | A1 | 6/2012 | Tomberlin et al. |
| 2015/0378044 | A1 | 12/2015 | Brooks |

FOREIGN PATENT DOCUMENTS

| | | | |
|---|---|---|---|
| EP | 1149225 | B1 | 4/2004 |

OTHER PUBLICATIONS

International Search Report and Written Opinion issued in International Application No. PCT/US2017/031583, dated Jul. 19, 2017 (8 pages).

*Primary Examiner* — Taras P Bemko
(74) *Attorney, Agent, or Firm* — Adolf Locklar

(57) ABSTRACT

A method for determining the direction and/or range from a drilling well to a target well may include positioning a magnetic source in the target well and a magnetic sensor in the drilling well. The method may include activating the magnetic source in the target well and moving one or both of the magnetic source and magnetic sensors until a location in which the magnetic sensor is not saturated is identified. The method may include determining the direction and/or range to the target well at that location.

11 Claims, 2 Drawing Sheets

MAGNETIC RANGING FROM BEHIND A MAGNETIC SHIELD

CROSS-REFERENCE TO RELATED APPLICATIONS

This application is a nonprovisional application which claims priority from U.S. provisional application No. 62/333,695, filed May 9, 2016.

TECHNICAL FIELD/FIELD OF THE DISCLOSURE

The present disclosure relates generally to downhole drilling and specifically to magnetic ranging between downhole tools.

BACKGROUND OF THE DISCLOSURE

When drilling a wellbore, knowledge of surrounding features and other wellbores may be necessary to avoid intersecting the wells. In one example, when sidetracking a wellbore where another wellbore is located in close proximity, knowledge of the location of the second well relative to the first well may be necessary to avoid drilling into the second well. In another example, where one wellbore of two splitter wells—wellbores spudded from inside the same surface conductor—is to be sidetracked, because the two splitter wells are in close proximity, the risk of colliding with the second splitter well may be increased due to the close proximity of the wells. Typically, magnetic ranging may be used to determine range and distance between wells when the well to be sidetracked, referred to herein as the drilling well, is uncased and the second well, referred to herein as the target well, is cased. However, where the drilling well is cased, magnetic fields from the target well may be shielded or perturbed by the casing.

SUMMARY

The present disclosure provides for a method. The method may include forming a target well in an earthen formation and forming a drilling well in the earthen formation. The method may include positioning a magnetic source in the target well. The method may include positioning a magnetic sensor in the drilling well. The method may include activating the magnetic source. The method may include measuring the magnetic field in the drilling well as the magnetic sensor is moved through the drilling well. The method may include identifying a location in the drilling well in which the magnetic sensor is not saturated. The method may include determining the direction and/or range to the target well at the location.

The present disclosure provides for a method. The method may include forming a target well in an earthen formation. The method may include forming a drilling well in the earthen formation. The method may include positioning a magnetic source and a first magnetic sensor in the target well. The method may include positioning a second magnetic sensor in the drilling well. The method may include measuring the magnetic field in the target well as the first magnetic sensor is moved through the target well. The method may include identifying a location in the target well in which the first magnetic sensor is not saturated. The method may include activating the magnetic source at the location in the target well. The method may include positioning the second magnetic sensor at a corresponding location in the drilling well. The method may include determining the direction and/or range to the target well at the corresponding location.

The present disclosure provides for a method. The method may include forming a target well in an earthen formation. The method may include forming a drilling well in the earthen formation. The method may include positioning a magnetic source in the target well at a first location having a known direction and range to the drilling well. The method may include positioning a magnetic sensor in the drilling well at a corresponding location. The method may include activating the magnetic source. The method may include measuring the magnetic field in the drilling well with the magnetic sensor. The method may include determining the shielding and interference of the magnetic field. The method may include determining the direction and/or range to the target well at a second location in the drilling well.

The present disclosure provides for a method. The method may include forming a target well in an earthen formation. The method may include forming a drilling well in the earthen formation. The method may include positioning a magnetic source in the target well. The method may include positioning a magnetic sensor in the drilling well. The method may include supplying oscillating current to the magnetic source. The method may include degaussing at least a portion of a casing of the target well. The method may include activating the magnetic source. The method may include measuring the magnetic field in the drilling well. The method may include determining the direction and/or range to the target well at the location.

The present disclosure provides for a method. The method may include forming a target well in an earthen formation. The method may include forming a drilling well in the earthen formation. The method may include positioning a first magnetic source in the target well. The method may include positioning a magnetic sensor and a second magnetic source in the drilling well. The method may include supplying oscillating current to the second magnetic source. The method may include degaussing at least a portion of a casing of the drilling well. The method may include activating the first magnetic source. The method may include measuring the magnetic field in the drilling well. The method may include determining the direction and/or range to the target well at the location.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
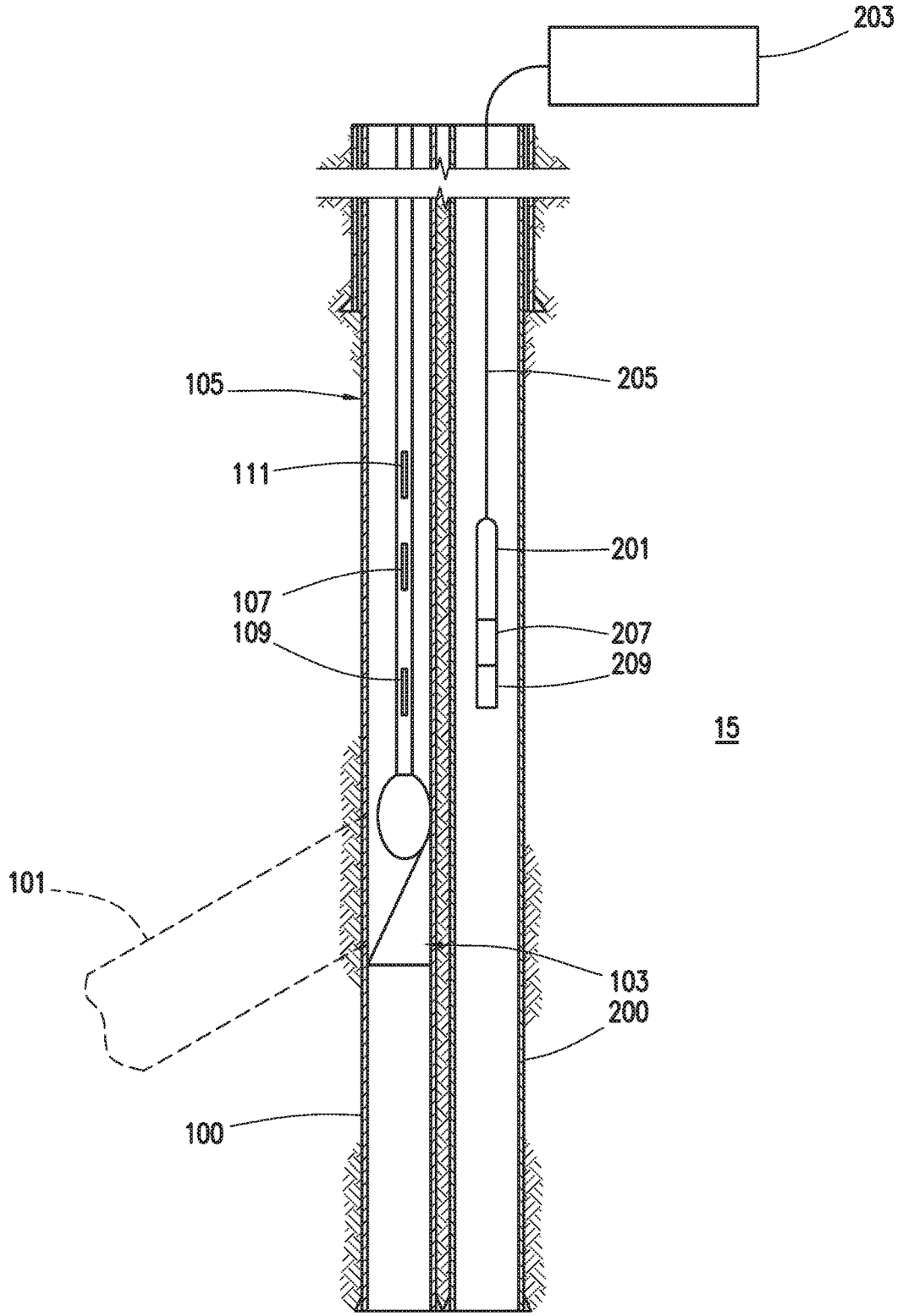
FIG. 1 depicts a magnetic ranging operation between two wellbores consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling well 100 and target well 200. Drilling well 100 and target well 200 may, in some embodiments, be formed in earthen formation 15. In some embodiments, drilling well 100 and target well 200 may be in close proximity. In some embodiments, a sidetrack well (depicted as sidetrack 101) may be formed from drilling well 100 to form sidetrack 101. Sidetracking drilling well 100 may involve the placement of whipstock 103 in drilling well 100. Whipstock 103 may be used to direct drill string 105 to extend radially outward from drilling well 100 in the direction of whipstock 103.

In some embodiments, both drilling well 100 and target well 200 may be cased. In some embodiments, whipstock 103 may be positioned in drilling well 100 such that sidetrack 101 does not intercept target well 200. Although discussed herein as utilizing whipstock 103 to orient and initiate sidetrack 101, one having ordinary skill in the art with the benefit of this disclosure will understand that any directional drilling mechanism may be utilized without deviating from the scope of this disclosure. For example and without limitation, in some embodiments, a bridge plug, cement plug, or bridge plug and cement plug may be utilized to kick-off a directional drilling device having a mud motor. In some embodiments, magnetic source 201 may be positioned within target well 200. Magnetic source 201 may, in some embodiments, be a wireline-deployed active magnetic ranging source. Although discussed herein as being deployed on wireline 205, one having ordinary skill in the art with the benefit of this disclosure will understand that magnetic source 201 may be deployed in any suitable way known in the art without deviating from the scope of this disclosure, including, for example and without limitation, on wireline 205, a tubing string, or drill pipe Magnetic source 201 may, in some embodiments, include a solenoid. In some embodiments, magnetic source 201 may be controllable. In some embodiments, the polarity, current, and voltage supplied to magnetic source 201 may be controlled by surface controller 203. In some embodiments, additional instrumentation may be included with magnetic source 201 including, for example and without limitation, telemetry systems to send or receive data or logging tools for logging wellbore parameters within target well 200. In some embodiments, magnetic field sensor 207 may be included with magnetic source 201. In some embodiments, casing collar locator 209 may be included with magnetic source 201. Casing collar locator 209 may be used to, for example and without limitation, detect and identify whether magnetic source 201 is located adjacent to a collar of the casing of target well 200. In some embodiments, one or more of a neutron tool or casing thickness tool may be included with magnetic source 201. In some embodiments, surface controller 203 may be coupled to magnetic source 201 by wireline 205.

Figure 2:
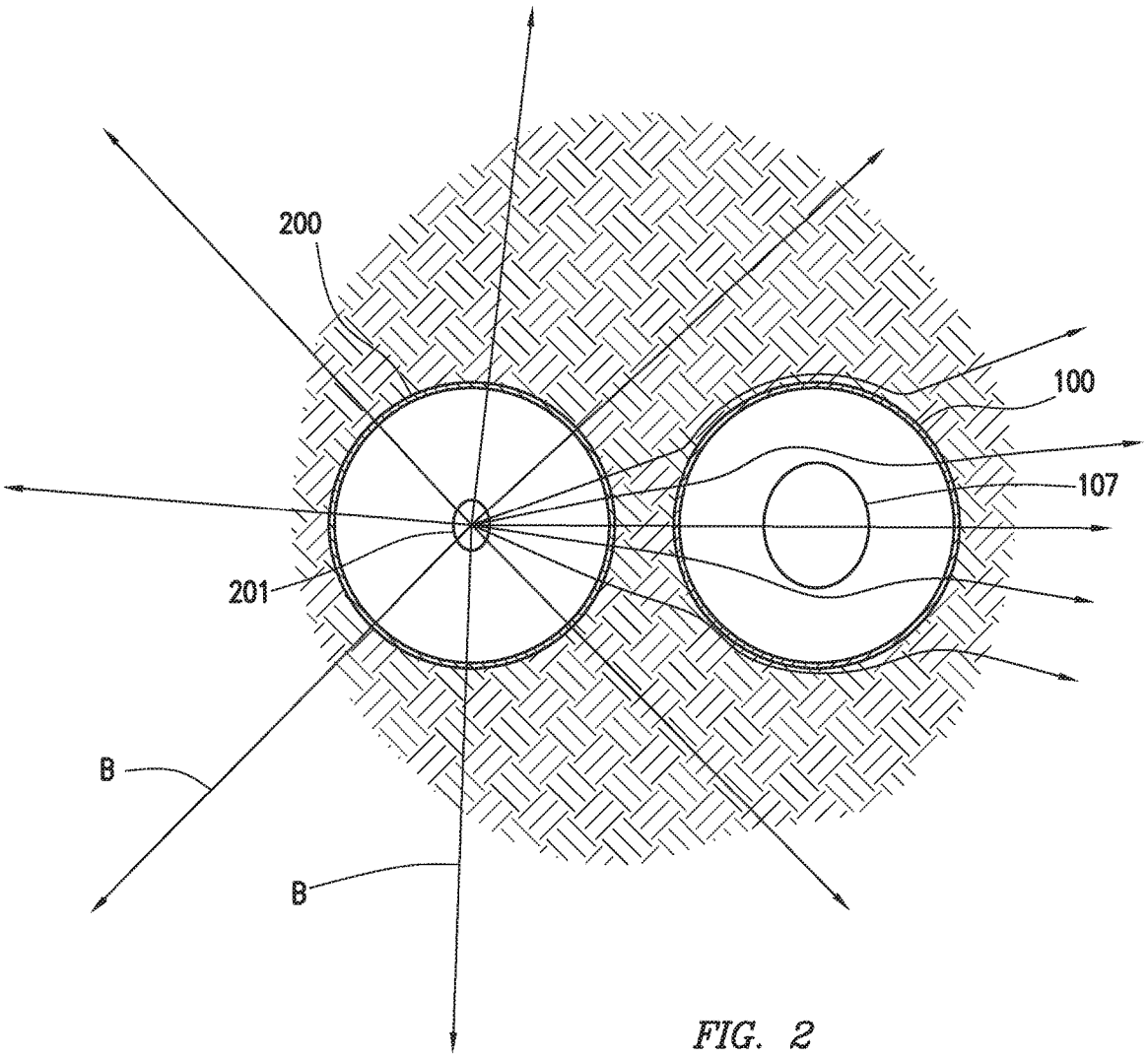
FIG. 2 depicts a top view of the magnetic ranging operation of FIG. 1.

In some embodiments, drill string 105 may include one or more magnetic sensors 107. Although described herein as utilizing drill string 105, one having ordinary skill in the art with the benefit of this disclosure will understand that magnetic sensors 107 may be introduced into drilling well by any suitable method known in the art including, for example and without limitation, drill pipe, wireline, or tubing string. Magnetic sensors 107 may include one or more magnetometers. Magnetic sensors 107 may be included as part of a measurement-while-drilling (MWD) package. Magnetic sensors 107 may, in some embodiments, be utilized to determine the direction, range, or direction and range of target well 200 from drilling well 100 as discussed herein below. In some embodiments, drill string 105 may include one or more gyro sensors and/or accelerometers 109 to determine azimuth and inclination of drilling well 100 and whipstock 103 and may be utilized as part of the direction and/or ranging determination. As depicted in FIG. 2, magnetic source 201 may generate magnetic field B which extends from target well 200. However, the casing of drilling well 100 may, for example and without limitation, affect the magnetic field reaching magnetic sensors 107 of drill string 105. Drill string 105 could be wire or tube With further reference to FIG. 1, in some embodiments, in order to determine the direction and/or range of target well 200 relative to drilling well 100, magnetic source 201 may be positioned within target well 200 and may be activated. In some embodiments, drill string 105 with magnetic sensors 107 may be inserted into drilling well 100. In some embodiments, as drill string 105 is inserted into drilling well 100, magnetic sensors 107 may be utilized to log magnetic properties of any interference or shielding of the signal generated by magnetic source 201 along the length of drilling well 100. In some embodiments, one or more locations along drilling well 100 may exhibit less interference or shielding between target well 200 and drilling well 100. In some embodiments, magnetic sensors 107 may make one or more measurements of magnetic field readings in drilling well 100. In some embodiments, the measurements of magnetic field readings may be transmitted to a surface receiver. In some embodiments, mud pulse telemetry may be used to transmit the measurements of magnetic field readings. In some embodiments, the measurements of magnetic sensors 107 may be used to determine locations along drilling well 100 in which magnetic sensors 107 are not saturated, meaning that the measured magnetic field is within the suitable range of measurement for magnetic sensors 107. At such locations along drilling well 100, the measured magnetic field may be utilized to determine the direction and/or distance to target well 200. In some embodiments, a casing collar locator (not shown) may be included in drill string 105 to determine whether magnetic sensors 107 are adjacent to a collar of drilling well 100 or target well 200. Once suitable locations are identified, a determination of range and/or direction from drilling well to target well 200 may be performed at one or more of the identified suitable locations. In some embodiments, magnetic field sensor 207 within target well 200 may be similarly utilized to identify locations of low magnetism in target well 200.

In some embodiments, magnetic sensors 107 may be utilized to determine the effect of interference and or shielding between magnetic source 201. As understood in the art, the amount of shielding and interference from the casings of drilling well 100 and target well 200 may depend on the material and configuration of these wells. Additionally, shielding may not be uniform along the length of drilling well 100 and target well 200. For example and without limitation, in a cylindrical shield, the external cross-axis field may be shielded more strongly than an along-axis field. The shielding effect may be determined by several processes. For example, in some embodiments, magnetic source 201 may be moved along target well 200 without shifting the location of magnetic sensors 107 in drilling well 100. In some embodiments, the range and direction between drilling well 100 and target well 200 may be measured at a known orientation and distance, such as near the surface, and interference and shielding determined thereby. In some embodiments, a calibration may be undertaken at the surface utilizing representative casing elements. In some embodiments, one or more computational models of magnetic material response may be used to establish the shielding and interference parameters. Once these parameters are known, the external field may be computed from the magnetic field measured by magnetic sensors 107 and the direction and/or distance between drilling well 100 and target well 200 may be determined.

In some embodiments, magnetic source 201 may be utilized to, for example and without limitation, generate a magnetic field to induce magnetization in the casing of target well 200. The induced magnetization in the casing of target well 200 may be utilized to reduce or counteract any magnetization in the casing. For example, in some embodiments, an oscillating driving current may be supplied to magnetic source 201. Magnetic source 201 may induce an oscillating magnetic field to degauss the casing of target well 200. Applying an oscillating, decaying magnetic field to the casing of target well 200 may, without being bound to theory, misalign iron domains in the casing to reduce the magnetic field of the casing. In some embodiments, magnetic source 201 may be moved through target well 200 to demagnetize the casing of target well 200. In some embodiments, magnetic source 111 may be included with drill string 105 to similarly degauss the casing of drilling well 100. In some embodiments, magnetic source 201 and magnetic source 111 may be a solenoid such as a solid core solenoid or a length of wire.

In some embodiments, magnetic source 201 and magnetic sensors 107 may be utilized to transmit information from target well 200 to drilling well 100. In some embodiments, magnetic source 111 and magnetic field sensor 207 may be utilized to transmit information from drilling well 100 to target well 200. In such embodiments, information may be encoded according to any suitable known encoding scheme into electromagnetic signals and transmit data from the magnetic source to the sensor in the other well.

Once the direction and/or range of target well 200 relative to drilling well 100 is determined, whipstock 103 may be placed within drilling well 100 and oriented such that sidetrack 101 does not intercept target well 200. In some embodiments, sidetrack 101 may then be formed with drill string 105 in a direction such that it does not intercept target well 200.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

forming a target well in an earthen formation;

forming a drilling well in the earthen formation;

positioning a magnetic source in the target well;

positioning a magnetic sensor in the drilling well;

activating the magnetic source;

continuously measuring the magnetic field in the drilling well as the magnetic sensor is moved through the drilling well while the magnetic source is active to determine whether the magnetic sensor is saturated or not saturated;

identifying a location in the drilling well in which the magnetic sensor is not saturated while the magnetic source is active based on the measured magnetic field while the magnetic sensor is moved through the drilling well; and determining the direction and/or range to the target well at the location.

2. The method of claim 1, further comprising:

identifying a second location in the drilling well in which the magnetic sensor is not saturated; and determining the direction and/or range to the target well at the second location.

3. The method of claim 1, further comprising:

forming a sidetrack from the drilling well in a direction other than the determined direction to the target well.

4. A method comprising:

forming a target well in an earthen formation;

forming a drilling well in the earthen formation;

positioning a magnetic source and a first magnetic sensor in the target well;

positioning a second magnetic sensor in the drilling well;

measuring the magnetic field in the target well as the first magnetic sensor is moved through the target well;

identifying a location in the target well in which the first magnetic sensor is not saturated;

activating the magnetic source at the location in the target well;

positioning the second magnetic sensor at a corresponding location in the drilling well; and determining the direction and/or range to the target well at the corresponding location.

5. The method of claim 4, further comprising:

identifying a second location in the target well in which the first magnetic sensor is not saturated; and determining the direction and/or range to the target well at the second location.

6. The method of claim 4, further comprising:

forming a sidetrack from the drilling well in a direction other than the determined direction to the target well.

7. A method comprising:

forming a target well in an earthen formation;

forming a drilling well in the earthen formation;

positioning a magnetic source in the target well at a first location having a known direction and range to the drilling well;

positioning a magnetic sensor in the drilling well at a corresponding location;

activating the magnetic source;

measuring the magnetic field in the drilling well with the magnetic sensor while the magnetic source is active;

determining shielding and interference parameters of the magnetic field while the magnetic source is active using one or more computational models of magnetic material response measuring the magnetic field at a second location in the drilling well; and determining the direction and/or range to the target well at the second location in the drilling well using the measured magnetic field and the shielding and interference parameters.

8. The method of claim 7, wherein the first location is near the surface.

9. The method of claim 7, wherein the first location utilizes representative casing elements at the surface.

10. A method comprising:

forming a target well in an earthen formation;

forming a drilling well in the earthen formation;

positioning a magnetic source in the target well;

positioning a magnetic sensor in the drilling well;

supplying oscillating current to the magnetic source;

inducing an oscillating magnetic field with the magnetic source to degauss at least a portion of a casing of the target well;

activating the magnetic source;

measuring the magnetic field in the drilling well; and determining the direction and/or range to the target well at the location.

11. A method comprising:

forming a target well in an earthen formation;

forming a drilling well in the earthen formation;

positioning a first magnetic source in the target well;

positioning a magnetic sensor and a second magnetic source in the drilling well;

supplying oscillating current to the second magnetic source;

inducing an oscillating magnetic field with the magnetic source to degauss at least a portion of a casing of the drilling well;

activating the first magnetic source;

measuring the magnetic field in the drilling well; and determining the direction and/or range to the target well at the location.

* * * * *